US005746890A

United States Patent [19]

Forslund

[11] Patent Number: 5,746,890

[45] Date of Patent: May 5, 1998

[54] DEVICE FOR ADMIXING A PROCESSING AGENT INTO A PULP SUSPENSION

[75] Inventor: Kjell Forslund, Sundsbruk, Sweden

[73] Assignee: Sunds Defibrator Industries AB, Sweden

[21] Appl. No.: 640,783

[22] PCT Filed: Oct. 27, 1994

[86] PCT No.: PCT/SE94/01009

§ 371 Date: May 22, 1996

§ 102(e) Date: May 22, 1996

[87] PCT Pub. No.: WO95/17243

PCT Pub. Date: Jun. 29, 1995

[30] Foreign Application Priority Data

Dec. 21, 1993 [SE] Sweden ..... 9304240

[51] Int. Cl.[6] ..... B01F 5/00

[52] U.S. Cl. ..... 162/243; 162/248; 366/302; 366/307

[58] Field of Search ..... 162/243, 248; 261/123; 366/336–8, 340, 253, 292, 302, 304, 306, 307; 422/228, 229

[56] References Cited

U.S. PATENT DOCUMENTS 2,139,430 12/1938 Witham, Jr. ..... 366/302

5,118,199 6/1992 Howk ..... 366/292

FOREIGN PATENT DOCUMENTS 453464 2/1988 Sweden .

85/01452 4/1985 WIPO .

OTHER PUBLICATIONS

Patent Abstracts of Japan, vol. 10, No. 269, C–372, abstract ofJP, A, 61–93819 (Teikoku Denki Seisakusho K.K.), 12 May 1986.

*Primary Examiner*—Donald E. Czaja
*Assistant Examiner*—Steven B. Leavitt
*Attorney, Agent, or Firm*—Lerner, David, Littenberg, Krumholz & Mentlik

[57] ABSTRACT

Mixing devices for mixing a processing agent with a pulp suspension are disclosed including a mixing vessel, an agitator mounted on the surface of the mixing vessel to create a flow of the pulp suspension across the mixing vessel, a processing agent supply for supplying processing agent to the flow of pulp suspension, and a flow divider mounted on the inner surface of the mixing vessel opposite the agitator, in which the flow divider includes a substantially vertical front distribution edge and a pair of arcuate front surfaces extending from that edge to the inner surface of the mixing vessel on opposite sides thereof.

10 Claims, 2 Drawing Sheets

DEVICE FOR ADMIXING A PROCESSING AGENT INTO A PULP SUSPENSION

FIELD OF THE INVENTION

The present invention relates to a device for admixing a processing agent into a pulp suspension in a vessel. More, particularly, the present invention relates to such a device in which the processing agent can consist of liquids and chemicals, substantially in a fluid state, which can be used for dilution or other types of processing.

BACKGROUND OF THE INVENTION

It is of decisive importance to obtain persistently uniform and proportional admixture of the processing agent with the pulp if one wishes to achieve acceptable results in various types of pulp processing.

In those arrangements which are presently utilized, the processing agent is mixed together in the lower portion of a pulp vessel. The pulp concentration in the pulp vessel is normally between about 10 and 20%, which must be lowered to about 2.5 and 8% in order to make it possible to pump the pulp suspension out of the vessel. When the pulp vessel is used as a bleaching tower, it is then necessary to supply a dilution fluid through a number of nozzles in a restricted lower portion of the tower. The bottom zone of the tower in such a case is restricted by a cylindrical cone in order to guide the processing agent in a circular manner.

The use of a high pulp concentration, for example, of about 12%, in the vessel renders it problematic to achieve a uniform admixture. In order to reduce this problem, the size of the vessel has generally been reduced. However, such an arrangement nevertheless requires considerable energy, due to incomplete admixture techniques and to an unsuitable configuration of the bottom of the vessel.

SUMMARY OF THE INVENTION

In accordance with the present invention, these and other problems have now been overcome, and the supply and central distribution of the processing agent, as well as the flow of the suspension, has been improved. Thus, improved mixing results can now be achieved while, at the same time, energy consumption can be lowered to a minimum value.

In accordance with the present invention, this is accomplished by the discovery of a mixing device for mixing a processing agent with a suspension comprising a mixing vessel having an inner surface and including a lower cylindrical portion having a diameter, an agitator mounted with respect to the inner surface of the mixing vessel for creating a flow of the pulp suspension across the mixing vessel, processing agent supply means for supplying the processing agent to the flow of the pulp suspension across the mixing vessel, and a flow divider mounted with respect to the inner surface of the mixing vessel at a location substantially opposite the location of the agitator, the flow divider comprising a substantially vertical front distribution edge spaced from the inner surface of the mixing vessel and a pair of arcuate front surfaces extending from the front distribution edge to the inner surface of the mixing vessel on opposite sides of the front distribution edge.

In accordance with a preferred embodiment, the pair of arcuate front surfaces are substantially vertical.

In accordance with one embodiment of the mixing device of the present invention, the suspension comprises a pulp suspension. In a preferred embodiment, the pair of arcuate front surfaces extend to the inner surface of the mixing vessel substantially tangentially.

In accordance with another embodiment of the mixing device of the present invention, the front distribution edge is directly opposite the agitator. In a preferred embodiment, the front distribution edge is located on a diameter of the mixing vessel, and the pair of arcuate front surfaces comprise cylindrical surfaces having a predetermined radius. In a preferred embodiment, the predetermined radius is between about 20 and 25% of the diameter of the mixing vessel.

In accordance with another embodiment of the mixing device of the present invention, the pair of arcuate front surfaces include an upper surface defining an inclined plane with respect to the inner surface of the mixing vessel. Preferably, the front distribution edge has a height, which is between about 10 and 20% of the diameter of the mixing vessel. Preferably, the upper surface of the pair of arcuate front surfaces have a maximum height which is between about 40 and 60% of the diameter of the mixing vessel.

BRIEF DESCRIPTION OF THE DRAWINGS

The present invention will be more fully appreciated with reference to the following detailed description, which, in turn, refers to the Figures, in which.

DETAILED DESCRIPTION

Figure 1:
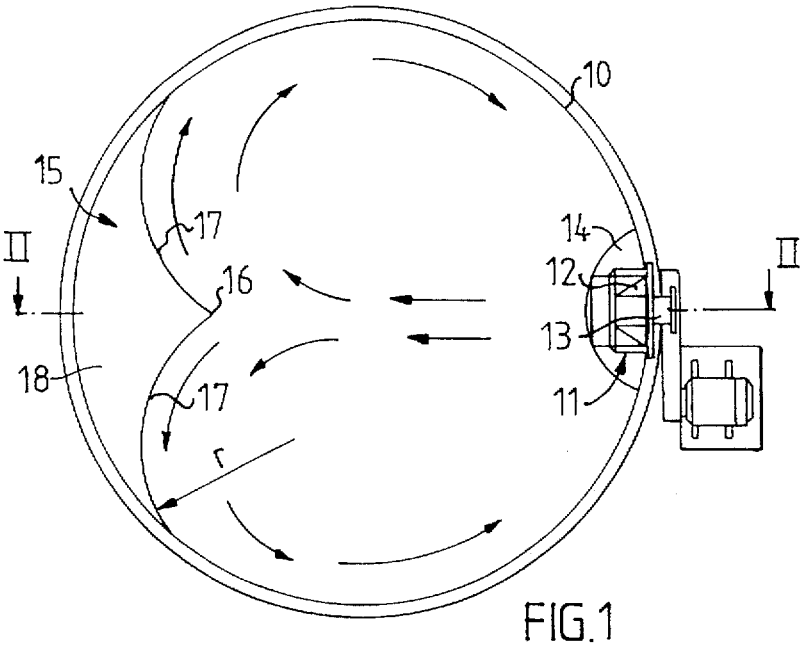
FIG. 1 is a top elevational view showing the lower portion of a mixing vessel in accordance with the present invention.
Figure 2:
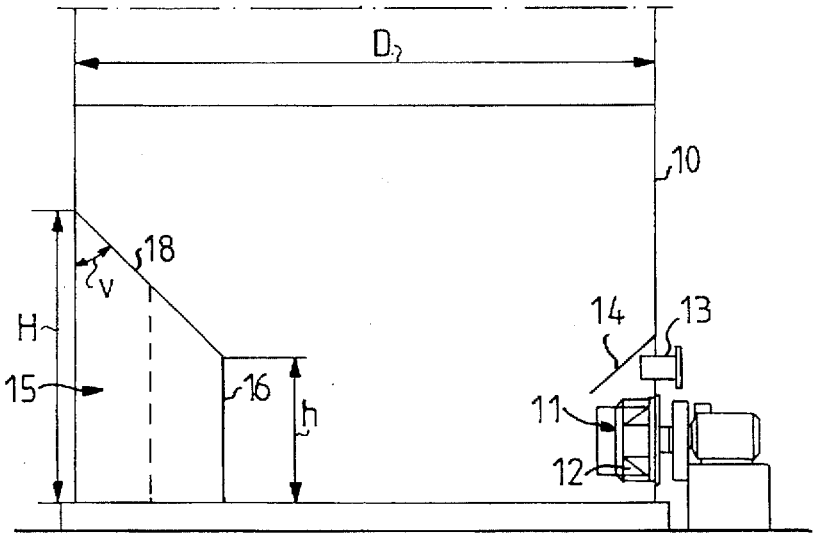
FIG. 2 is a side, sectional, partially perspective view of the mixing vessel shown in FIG. 1 taken along lines II—II thereof.
Figure 3:
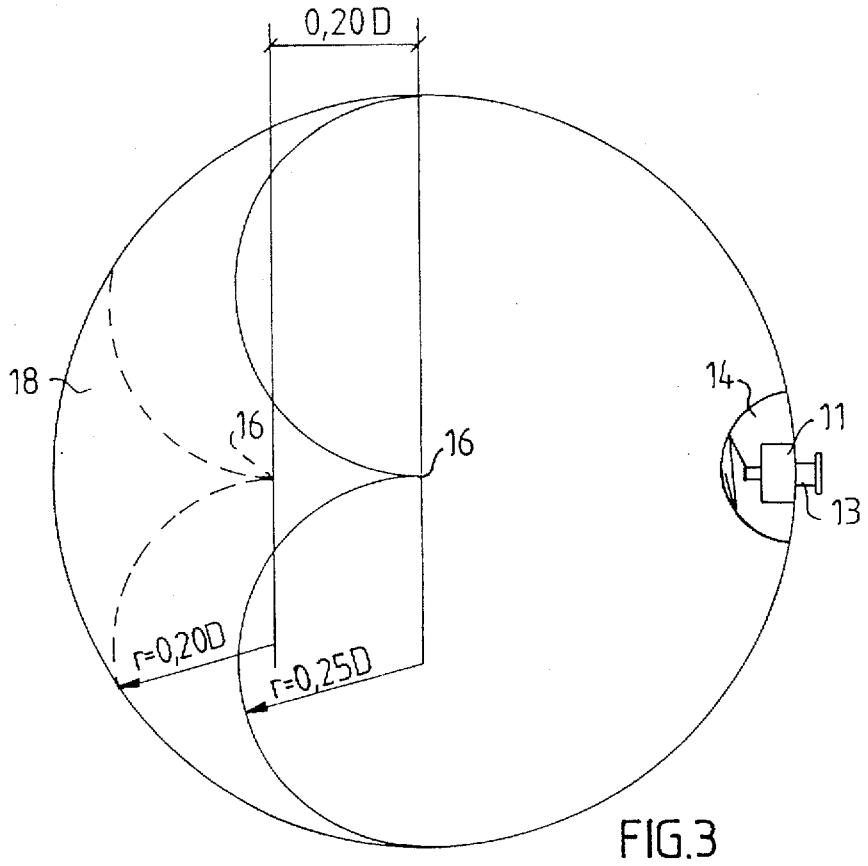
FIG. 3 is a top schematic representation of another mixing vessel in accordance with the present invention.
Figure 4:
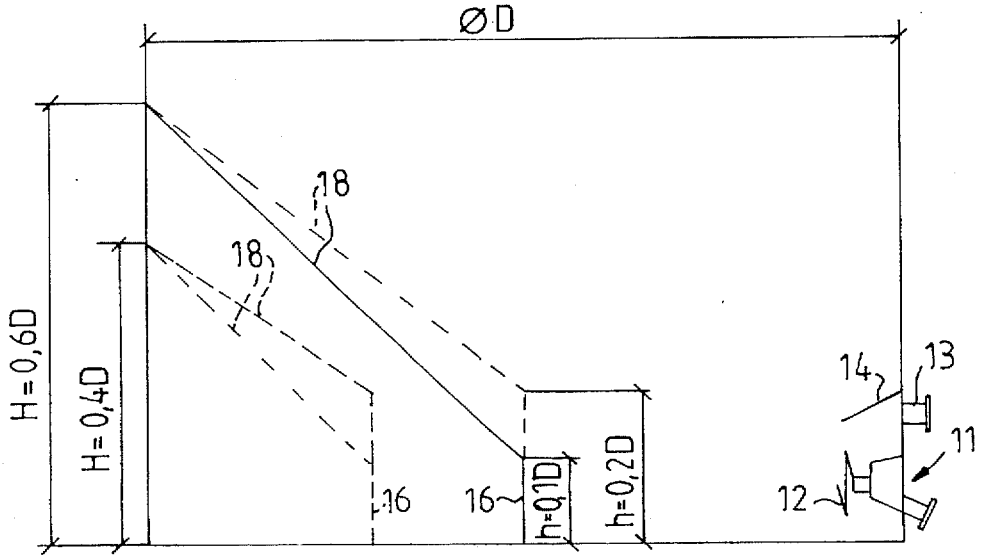
FIG. 4 is a side perspective schematic representation of a mixing vessel in accordance with the present invention.

Referring to the Figures, in which like reference numerals refer to like elements thereof, the mixing vessel according to FIG. 1 comprises a cylindrical lower portion 10. An agitator 11 is fitted into the wall of the lower portion of the vessel. The agitator 11 comprises a propeller 12, which is intended to establish a pulp flow across the vessel portion 10 simultaneously as a processing agent is supplied to the pulp flow. According to the embodiment shown therein, the processing agent is supplied through a pipe 13 located above the suction side of the agitator 11, and an inclined screen 14 is located in the vessel above the pipe 13. Screen 14 is intended to distribute the ingoing processing agent on the suction side of the agitator 11, and at the same time to prevent air from being sucked in from the surface of the pulp suspension in the vessel. There is a risk of air being sucked in when the level in the vessel approaches the level of the agitator.

As an alternative, the propeller agitator can be designed in a different manner, for example as shown in Swedish Patent Application No. 9202011-4.

Diametrically opposite the agitator 11, the lower portion 10 of the vessel is formed with a flow divider 15. A substantially vertical distribution edge 16 on the front of this flow divider 15 is located on the central line of the agitator 11 at a distance form the wall of the vessel portion 10. Two arc-shaped substantially vertical surfaces 17 extend, one in each direction, from the distribution edge 16 outwardly to the vessel wall, which these surfaces 17 join substantially tangentially. The surfaces 17 are symmetrical as regards the distribution edge 16 and are defined upwardly by an inclined plane 18 forming an angle v with the vessel wall.

The arc-shaped surfaces 17 are preferably cylindrical with a radius r which is between about 20 and 25% of the diameter D of the vessel portion 10. The center axis of each of the arc-shaped surfaces 17 and the distribution edge 16 should be located in the opposed half of the vessel portion 10 in relation to the agitator 11, but the distance between that center axis and the distribution edge and the imaginary plane, respectively, dividing the vessel portion 10 into two halves, should be less than about 20% of the diameter D.

The height h of the distribution edge 16 should be from about 10 to 20% of the diameter D, measured from the vessel bottom. The highest point where the inclined plane 18 joins the wall of the vessel portion 10 should be located at a height H above the vessel bottom, where H lies in the interval of from about 40 to 60% of the diameter D. The angle v determined by the difference between the heights h and H should be about 45°.

Due to the design of the lower portion 10 of the vessel provided with a flow divider 15, the throw length of the agitator 11 is shortened and at the same time the pulp flow is divided into two partial flows of equal size. These partial flows flow back along the vessel wall, and then back to the suction side of the agitator 11 where the inclined plane 18 simultaneously produces a certain upward deflection. The pulp flow directed in this manner yields very effective mixing and requires less energy supply than mixing arrangements which have heretofore been utilized.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A mixing device for mixing a processing agent with a suspension comprising a mixing vessel having an inner surface and including a lower cylindrical portion having a diameter, an agitator mounted with respect to said inner surface of said mixing vessel for creating a flow of said suspension across said mixing vessel, processing agent supply means for supplying said processing agent to said flow of said suspension across said mixing vessel, and a flow divider mounted with respect to said inner surface of said mixing vessel at a location substantially opposite to the location of said agitator, said flow divider comprising a substantially vertical front distribution edge spaced from said inner surface of said mixing vessel and a pair of arcuate front surfaces extending from said front distribution edge to said inner surface of said mixing vessel on opposite sides of said front distribution edge, said pair of arcuate front surfaces including an upper surface defining an inclined plane with respect to said inner surface of said mixing vessel.

2. The mixing device of claim 1 wherein said pair of arcuate front surfaces are substantially vertical.

3. The mixing device of claim 1 wherein said suspension comprises a pulp suspension.

4. The mixing device of claim 1 wherein said pair of arcuate front surfaces extend to said inner surface of said mixing vessel substantially tangentially.

5. The mixing device of claim 1 wherein said front distribution edge is directly opposite said agitator.

6. The mixing device of claim 1 wherein said front distribution edge is located on a diameter of said mixing vessel, and said pair of arcuate front surfaces comprise cylindrical surfaces having a predetermined radius.

7. The mixing device of claim 6 wherein said predetermined radius is between about 20 and 25% of said diameter of said mixing vessel.

8. The mixing device of claim 1 wherein said front distribution edge has a height, said height being between about 10 and 20% of said diameter of said mixing vessel.

9. The mixing device of claim 8 wherein said upper surface of said pair of arcuate front surfaces has a maximum height, said maximum height being between about 40 and 60% of said diameter of said mixing vessel.

10. The mixing device of claim 1 wherein said inner surface of said mixing vessel includes a bottom surface, said bottom surface being substantially horizontal whereby said agitator creates a flow of said suspension across said mixing vessel to said flow divider which is substantially unobstructed therebetween.

* * * * *